United States Patent [19]

Okamoto et al.

[11] 3,961,612

[45] June 8, 1976

[54] FUEL INJECTION DEVICE FOR DIESEL ENGINES

[75] Inventors: Kazuo Okamoto, Saitama; Nobuhiro Kaibara, Higashi-Matsuyama, both of Japan

[73] Assignee: Diesel Kiki Kabushiki Kaisha, Tokyo, Japan

[22] Filed: Aug. 22, 1974

[21] Appl. No.: 499,590

[52] U.S. Cl. ..... 123/139 E; 123/140 FG; 123/139 R; 123/32 AE

[51] Int. Cl.[2] ..... F02D 1/04; F02M 39/00

[58] Field of Search ..... 123/32 AE, 139 E, 140 FG, 123/139 R

[56] References Cited

UNITED STATES PATENTS

| | | | |
|---|---|---|---|
| 2,598,528 | 5/1952 | French | 123/139 E |
| 2,916,028 | 12/1959 | Mansfield | 123/139 E |
| 3,516,395 | 6/1970 | Bassot | 123/139 E |
| 3,592,177 | 7/1971 | Wehde | 123/139 E |
| 3,623,460 | 11/1971 | Komaroff | 123/139 E |
| 3,796,205 | 3/1974 | Links | 123/139 E |
| 3,796,206 | 3/1974 | Links | 123/139 E |

*Primary Examiner*—Charles J. Myhre
*Assistant Examiner*—Ronald B. Cox
*Attorney, Agent, or Firm*—Henry R. Lerner

[57] ABSTRACT

A fuel injection device for Diesel engines comprising a fuel system which includes a throttle member adapted to change the injection time corresponding to a variation in rotation of an engine and to meet such variation to rotary angle of the engine required for injection.

7 Claims, 7 Drawing Figures

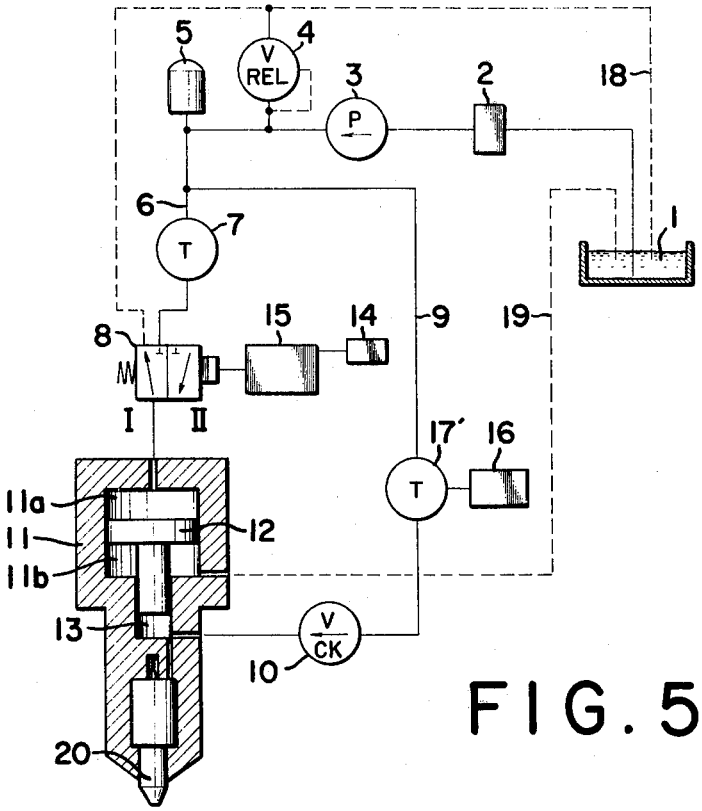
FIG. 4
FIG. 5
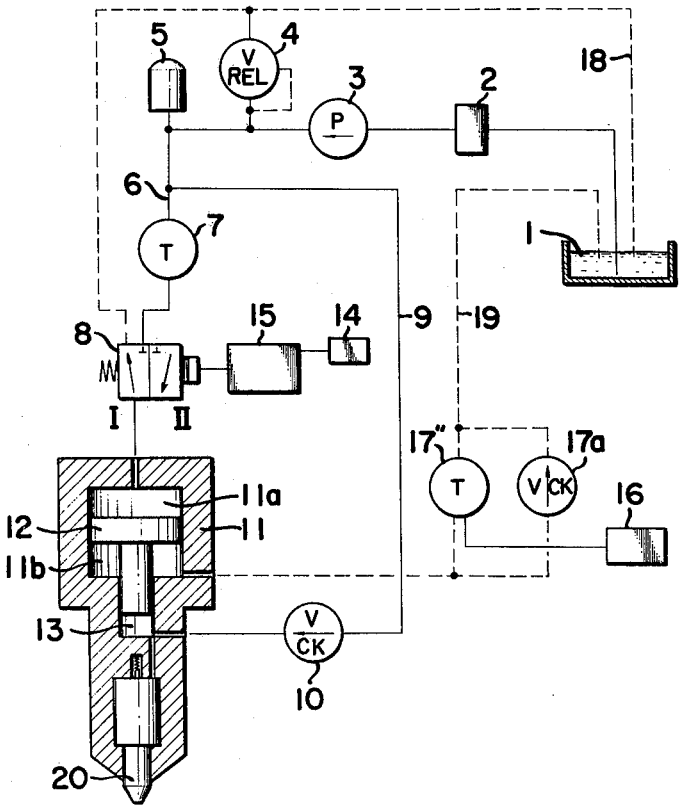

FUEL INJECTION DEVICE FOR DIESEL ENGINES

This invention relates to a fuel injection device for Diesel engines and more particularly to a fuel injection device in which the characteristics of fuel injection are made variable electrically and hydraulically so that engine performance may be freely adjusted.

Known fuel injection devices for Diesel engines having conventional fuel injection characteristics adjusted the amount of injected fuel by means of an electromagnetic valve. As the electromagnetic valve is operated by an ON-OFF control, a time t required for injection is constant for a same amount of injected fuel Q, and as the rotation is lowered the time period of injection does not increase so that an injection ratio dQ/dt does not change with the result that there occurs large noise at lower speeds of an engine.

An object of the present invention is to provide a fuel injection device comprising a fuel system which includes a throttle means adapted to change an injection time corresponding to the variation in the engine revolution to meet such variation to a rotation angle of the engine required for the injection and thereby to reduce the injection ratio during rotation at low speeds to decrease the noise.

Figure 1:
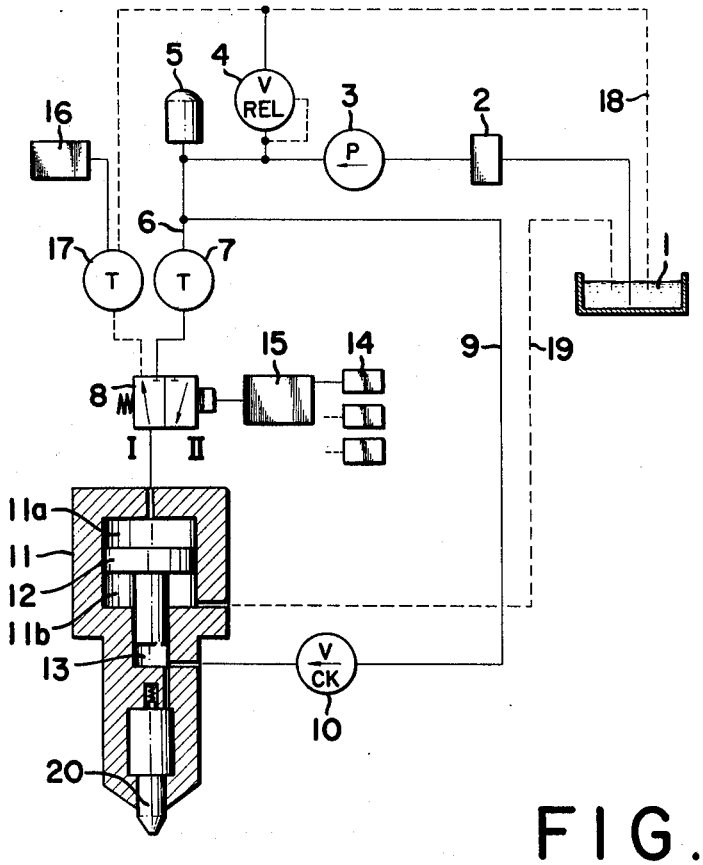
Figure 2:
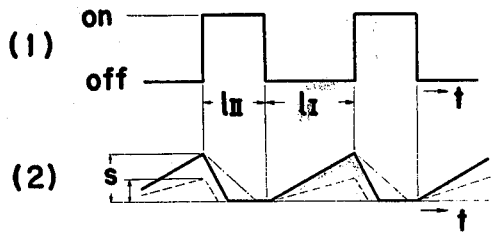
Figure 3:
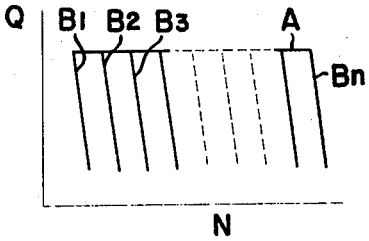
Figure 6:
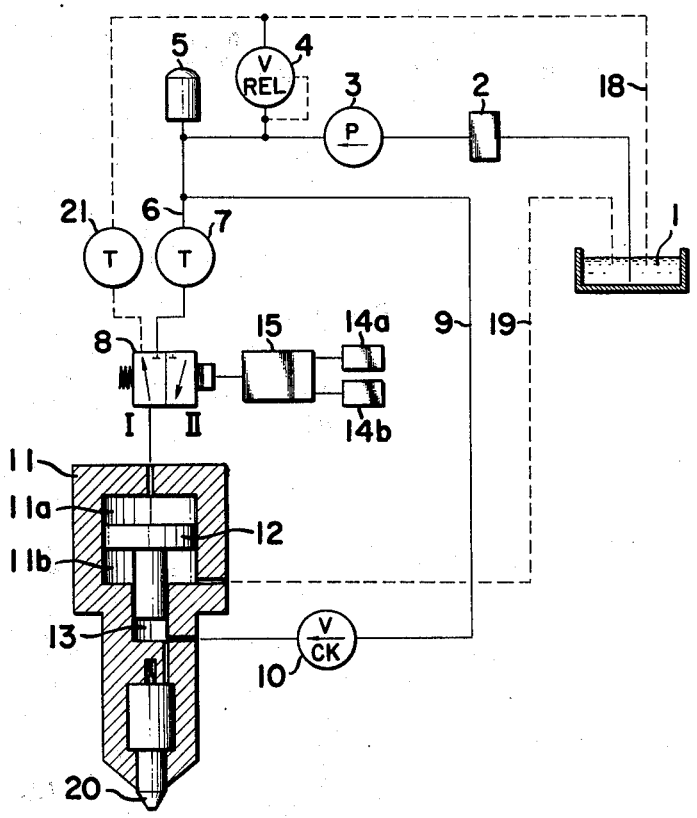
Figure 7:
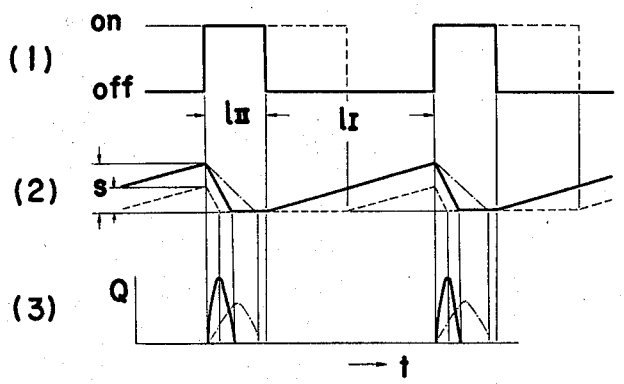

In order that the present invention may be more readily understood, reference will now be made, by way of example, to the accompanying drawings in which:

FIG. 1 is a diagrammatic view of the first embodiment of the present invention showing a basic structure of a fuel injection device of the present invention, FIG. 2 (1) is a view showing a pulse wave in which a pulse voltage is supplied to an electromagnetic valve and FIG. 2 (2) shows the operation characteristics of a servopiston varied by the pulse voltage, FIG. 3 is a view showing the relation between the amount of injected fuel Q of the fuel injection device of the present invention and the engine revolution N, FIG. 4 is a view similar to FIG. 1 showing a second embodiment of the present invention, FIG. 5 is a view similar to FIG. 1 showing a third embodiment of the present invention, FIG. 6 is a view similar to FIG. 1 showing a fourth embodiment of the present invention and FIG. 7 is a view with three portions showing a pulse wave, operation characteristics of a servopiston and amount of injected fuels, respectively.

Referring to FIG. 1, the fuel tank 1 is connected through a filter 2 to the suction side of a fuel supply pump 3. A relief valve 4 and an accumulator 5 are provided on the discharge side of the fuel supply pump 3. These are connected by a fuel conduit 6 through a variable throttle member 7 corresponding to an accelerator to an electromagnetic valve 8. A fuel conduit 9 branching from a point in front of the electromagnetic valve 8 is connected through a check valve 10 to a body 11 at a plunger chamber 13 under a small diameter portion of a servopiston 12, forming a large diamter portion. The electromagnetic valve 8 is operated by a circuit 15 having as an input an output from a detector circuit 14 for the atmospheric pressure and temperature, water temperature and the like. In a position I, the electromagnetic valve causes the servopiston chamber 11*a* in the body 11 to be connected to the fuel tank 1 through a variable throttle member 17 and a fuel conduit 18. The variable throttle member 17 is operated by an output of a circuit 16 for comparing the number of revolutions of the engine with the number of revolutions set by the accelerator. In its position II, the electromagnetic valve is adapted to supply the fuel pressure from the fuel supply pump 3 to the servopiston chamber 11a. A counter piston chamber 11*b* provided under the large diameter portion of the servopiston 12 is connected to the fuel tank 1 through the oil conduit 19 so as not to prevent movement of the servopiston 12. In FIG. 2 is shown an output of the circuit 15. A pulse 1 II controls the time period during which the electromagnetic valve 8 is in the position II, and a pulse 1 I controls the time period during which the electromagnetic valve 8 is in the position I. The amplitude of the pulse 1 I is made constant and a time period of the pulses 1 I + 1 II is reduced with a rise of speed of the engine. The shortest duration of the pulse II is defined to be a sufficient time for displacement of the servopiston 12 on a whole stroke S, while the variable throttle member 7 in association with movement of the accelerator is in the most throttled state. This time is prolonged with a decrease of the engine speed. The pulse 1 I is a period of time that the servopiston 12 is displaced in the whole stroke S so as to prepare a next maximum injection fuel. The variable throttle member 7 is adapted to open proportionately to the displacement of the accelerator and defines a speed of the stroke of the servopiston 12 in the direction of fuel injection. As shown in FIG. 2, relations between the servopiston stroke S and the time period of the pulses are represented by a chain-dot line when the variable throttle member 7 is in the most throttled state and by a solid line when it is in the most opened state. With the same amount of injection fuel, the time during which the servopiston displaces the stroke S varies. If in the circuit 16 for comparing the engine revolutions and the set number of the accelerator displacement, the number of the engine revolution is higher than the number set by the accelerator and their difference is large, the variable throttle member 17 is throttled and if the number of revolutions of the engine is lower than a number of revolution as previously set, the throttled amount of the variable throttle member 17 becomes small and the stroke speed in the direction of the fuel suction of the servopiston 12 is limited to effect a so-called speed governing. These relation are illustrated in FIG. 2 (2). The solid line in the pulse 1 I represents the most opened state of the variable throttle 17 and the broken line. The most throttled state.

The relation between throttle amounts of the variable throttle members 7 and 17 and numbers of revolution and injected fuel of an engine is represented by characteristic curves of FIG. 3. In FIG. 3, the line A represents the maximum amount of injected fuel in which the injected fuel amount Q is constant irrespective of variation of numbers of revolution, and lines B1, B2 . . . and Bn represent partial load characteristics defining a certain number of revolutions. The variable throttle member 7 varying a throttled amount by displacement of the accelerator represents by the line B1 of the characteristics during the lowest number of revolution and the line Bn of those of the highest number of revolution. The variable throttle member 17 opens in the line A at the maximum state and is set to be much more throttled as the number of revolutions becomes higher in the lines B1, B2 . . . and Bn.

In the above construction, a fuel in the fuel tank 1 as supplied under pressure through the filter 2 from the supply pump 3 is adjusted in its pressure by the relief valve 4 and is stored in the accumulator 5. When the electromagnetic valve 8 is in the position I, the stored fuel in the accumulator 5 flows through the oil conduit 9 and the check valve 10 into the plunger chamber 13 to push the servopiston 12 upward. As the servopiston 12 rises, the fuel in the servopiston chamber 11a passes through the electromagnetic valve 8, the variable throttle member and the fuel conduit 18 to the fuel tank 1.

When the electromagnetic valve 8 is in the position II, the stored fuel in the accumulator 5 passes through the variable throttle member 7 associated with the accelerator pedal and the electromagnetic valve 8 into the servopiston chamber 11a, depressing the servopiston 12, and the fuel in the plunger chamber 13 is injected from the injection nozzle 20 via a passage. The discharged fuel from the counter piston chamber 11b flows through the conduit 19 to the fuel tank 1 without preventing the movement of the servopiston 12.

Thus, by changing the positions I or II of the electromagnetic valve 8, it is possible to continue a fuel injection from the injection nozzle 20. While the engine is idling having the revolution control characteristic B1 responsive to the accelerator displacement being zero, the variable throttle member 7 is closed to a maximum so that time of depressing the servopiston 12 be longest. The variable throttle member 17 has a throttling amount providing injected fuel sufficient for the idling revolution speed. Accordingly, the rotational angle of the engine is large enough so that the injection rate during idling is small and the combustion noise can be decreased. By increase of the accelerator displacement, the characteristics B2, B3 . . . may be preferably selected, the throttle member 7 being increased in opening. For example, if load would increase in the form of line B3 and the number of revolutions of the engine is made lower than the predetermined number, the control point in the diagram showing injection amount Q and number of revolutions N may be displaced in the direction of increase of Q in the line B3, with the result that the throttle amount of the variable throttle member 17 may decrease, the amount of injected fuel increases, the number of revolution may be prevented from being reduced. Conversely, if the load is reduced and number of revolutions is increased, the operation may be reversely effected. The throttled amount in the variable throttle member 17 may be increased with the injected amount of fuel decreased. Then, increase of the number of revolution is prevented to maintain the set number of revolution. When the accelerator is displaced to maximum position, the difference between the set number of revolutions and the number of the engine revolutions would reach the maximum and the throttled amount of the variable throttle member 17 minimum. The injected amount of fuel as shown in FIG. 3 would reach the limit shown by line A and may be maximum. When the number of revolutions of the engine reaches the set one, the throttled amount of the variable throttle member 17 would reach the amount necessary for the set revolution.

The variable throttle member 7 which would vary with the accelerator displacement is thus provided in the fuel system on the high pressure side at the large diameter portion of the servopiston. The throttled amount of the variable throttle is made large when the accelerator displacement is small and is made small when the accelerator displacement is larger. The depressing speed in the servopiston is made variable so that the injection may be varied in response to the engine revolution for same injections. This is particularly effective for reducing the noise during low speed conditions.

FIG. 4 illustrates a second embodiment of this invention. This embodiment provides a modification in which the throttle member 17 in the first embodiment is replaced by a throttle member 17' acting to flow carry the fuel to the plunger chamber 13. Other constructions and operation are same as those of the first embodiment.

FIG. 5 is a third embodiment of this invention. In this embodiment the variable throttle member 17 associated with the accelerator to control the upward movement of the servopiston 12 is replaced by a variable throttle member 17'' in a passage connected to the counter-piston chamber 11b communicated only to the low pressure side of the fuel system, and provided in the lower part of the large diameter portion of the servopiston 12. The throttle member 17'' limits the fuel flowing into the chamber 11b during the upward movement of the servopiston. The check valve **17*a* is provided in parallel with the variable throttle member 17'' not to prevent the downward movement of the servopiston 12.**

Other constructions and operation are same as those of the first embodiment.

FIG. 6 illustrates a fourth embodiment of the invention. This embodiment provides a modification in which the variable throttle member 17 operated by the circuit 16 in the first embodiment is replaced by a fixed throttle member 21. As shown in FIG. 7 (1) pulses 1 I and 1 II are variable and a time period 1 I + 1 II is made small with increase of the engine revolution. If, in the circuit 16 for comparing number of the engine revolution and the set of the accelerator displacement, the number the engine revolution is higher than the number of revolution set by the accelerator and their difference is large, the electromagnetic valve is fed by a signal shortening a width of the pulse 1 I shown in FIG. 7 (2) and if the engine revolution is lower than the set revolution, the electromagnetic valve is fed by a signal lengthening a width of the pulse, to effect a so-called speed governing. The injected amount is shown in FIG. 7 (3). It is seen that injection rate is changed by variation of the acceleration displacement although there is no variation in injection amount. The variable throttle member 7 is set to be much more throttled as a number of revolution becomes lower. The width of the pulse 1 I is set to be most long in line A and to be much more shortened in lines B1, B2 . . . and Bn as a number of revolutions becomes higher. This width is one giving the injected amount necessary for the idling revolution. If the engine revolution is lower than the set revolution, the width of the pulse 1 I is lengthened to increase the injected amount and if the revolution becomes high, the width of the pulse 1 I is shortened. When the engine revolution becomes the set revolution, the width of the pulse 1 I becomes the necessary valve for maintaining the set revolution to shorten the servopiston displacement. The injection amount is lowered along the characteristics B1, B2 . . . and Bn so that the set revolution may be obtained. In this case, throttled amount in B1 > throttled amount in B2 . . . > throttled amount in Bn. The fixed throttle member 21 sets suitably a return speed of the servopiston 13.

The variable throttle members 17' and 17'' in FIGS. 4 and 5 respectively may be replaced by a fixed throttle member.

The variable throttle member may be operated by any mechanical means.

Many variations may be effected without departing from the spirit of the invention. It is to be understood that these, together with other variations in details, are anticipated by the appended claims.

We claim:

1. A fuel injection device for diesel engines comprising a body including a large diameter portion and a small diameter portion of a servopiston to define a piston chamber, a counter piston chamber and a plunger chamber, an electromagnetic valve, a fuel supply pump having a discharge portion, a fuel tank, a check valve preventing fuel from flowing out of said plunger chamber, said servopiston chamber being changeably connected by the electromagnetic valve to the fuel tank and to receive pressure from said fuel supply pump, said counter piston chamber being connected to the fuel tank and said plunger chamber being connected to said piston chamber through the check valve, a variable throttle member arranged between the electromagnetic valve and the discharges portion of the fuel supply pump, said variable throttle member varying in opening in proportion to the displacement of an accelerator, said variable throttle member controlling the stroke speed of the servopiston in the fuel injection direction when fuel is supplied under pressure, and a throttle means arranged in a conduit connected to said piston chamber, the stroke speed of the servopiston in the fuel suction direction being controlled by the throttle means.

2. A fuel injection device according to claim 1 wherein said throttle means comprises a variable throttle member arranged between the electromagnetic valve and the fuel tank and varying in opening in inverse proportion to the speed of the engine and in proportion to the displacement of the accelerator, said electromagnetic valve comprising means for ensuring a constant fuel injection and means for varying the amount of fuel suction in inverse proportion to the speed of the engine.

3. A fuel injection device according to claim 1 wherein said throttle means comprises a variable throttle member arranged between the plunger chamber and the discharge portion of the fuel supply pump and varying in opening in inverse proportion to the speed of the engine and in proportion to the displacement of the accelerator, said electromagnetic valve comprising means for ensuring a constant fuel injection and means for varying the amount of fuel suction in inverse proportion to the speed of the engine.

4. A fuel injection device according to claim 1 wherein said throttle means comprises a variable throttle member arranged between the counter piston chamber and the fuel tank and varying in opening in inverse proportion to the speed of the engine and in proportion to the displacement of the accelerator, said electromagnetic valve comprising means for ensuring a constant fuel injection and means for varying the amount of fuel suction in inverse proportion to the speed of the engine.

5. A fuel injection device according to claim 1 wherein said throttle means comprises a fixed throttle member arranged between the electromagnetic valve and the fuel tank and said electromagnetic valve comprises means to vary the amount of fuel injection at least in inverse proportion to the speed of the engine.

6. A fuel injection device according to claim 1 wherein said throttle means comprises a fixed throttle member arranged between the plunger chamber and the discharge portion of the fuel supply pump and said electromagnetic valve comprises means to vary the amount of fuel injection at least in inverse proportion to the speed of the engine.

7. A fuel injection device according to claim 1 wherein said throttle means comprises a fixed throttle member arranged between the counter piston chamber and the fuel tank and said electromagnetic valve comprises means to vary the amount of fuel injection at least in inverse proportion to the speed of the engine.

* * * * *